US009482016B2

(12) United States Patent
Kelley

(10) Patent No.: US 9,482,016 B2
(45) Date of Patent: Nov. 1, 2016

(54) SHIPMENT AND INSTALLATION OF PRE-HUNG DOORS DEVICE AND METHOD

(71) Applicant: JenTra LLC, Backus, MN (US)

(72) Inventor: Travis John Kelley, Backus, MN (US)

(73) Assignee: Cardiac Pacemakers, Inc., St. Paul, MN (US)

( * ) Notice: Subject to any disclaimer, the term of this patent is extended or adjusted under 35 U.S.C. 154(b) by 0 days.

(21) Appl. No.: 14/947,949

(22) Filed: Nov. 20, 2015

(65) Prior Publication Data

US 2016/0145028 A1 May 26, 2016

Related U.S. Application Data

(60) Provisional application No. 62/082,953, filed on Nov. 21, 2014.

(51) Int. Cl.

| | |
|---|---|
| ***E06B 3/32*** | (2006.01) |
| ***E04F 21/00*** | (2006.01) |
| ***B65D 81/05*** | (2006.01) |
| ***E06B 7/28*** | (2006.01) |

(52) U.S. Cl.
CPC ..... *E04F 21/0007* (2013.01); *B65D 81/055* (2013.01); *E06B 7/28* (2013.01)

(58) Field of Classification Search
CPC ..... B65D 81/054; E06B 3/70; E06B 3/34; E06B 3/06; E04F 21/0007
USPC ..... 49/380; 206/325
See application file for complete search history.

(56) References Cited

U.S. PATENT DOCUMENTS

| | | | | | |
|---|---|---|---|---|---|
| 2,730,773 | A | * | 1/1956 | Logue | 49/380 |
| 3,301,820 | A | * | 1/1967 | Haendiges | 206/325 |
| 3,584,416 | A | * | 6/1971 | Baumgartel | 49/380 |
| 3,593,458 | A | * | 7/1971 | Wahlfeld et al. | 49/240 |
| 3,599,373 | A | * | 8/1971 | Coykendall | 49/380 |
| 4,001,972 | A | * | 1/1977 | Hurwitz | 49/380 |
| 4,278,244 | A | | 7/1981 | Carter | |
| 4,483,101 | A | * | 11/1984 | Berzina | 49/380 |

(Continued)

OTHER PUBLICATIONS

"Clip-on Stencil Level," http://www.cuttingedgestencils.com/stencil-level.html?category_id=1010, Innovative Art Concepts, LLC, at least as early as Feb. 18, 2011.

(Continued)

*Primary Examiner* — Jerry Redman
(74) *Attorney, Agent, or Firm* — Pauly, DeVries Smith & Deffner, LLC

(57) ABSTRACT

Embodiments include a door stabilization device. The door stabilization device can include a clip component, a first fastener portion, and a second fastener portion. The clip component can be configured to fit onto an edge of a door using a compression fit between the first side portion and the second side portion. The first fastener portion is configured to extend through a clip aperture defined by the clip component and at least partially into a latchbolt aperture defined by the door. The second fastener portion configured to mate with the first fastener portion and configured to fit at least partially within the latchbolt aperture and a door knob bore defined by the door. Other embodiments are also included herein.

20 Claims, 9 Drawing Sheets

(56) References Cited

U.S. PATENT DOCUMENTS

| | | | | | |
|---|---|---|---|---|---|
| 4,718,195 | A | * | 1/1988 | Ortega | 49/380 |
| 4,739,561 | A | * | 4/1988 | Mills | 33/370 |
| D319,007 | S | * | 8/1991 | Rogers et al. | D8/400 |
| 5,159,782 | A | * | 11/1992 | Sales | 49/380 |
| 5,209,017 | A | * | 5/1993 | Ridge | 49/380 |
| 5,375,334 | A | | 12/1994 | Coker | |
| 5,396,707 | A | | 3/1995 | Blase | |
| 5,488,804 | A | * | 2/1996 | Batscher | 49/462 |
| 5,562,315 | A | * | 10/1996 | Sales | 292/150 |
| 5,655,332 | A | * | 8/1997 | Papadopoulos | 49/380 |
| 5,718,082 | A | * | 2/1998 | Mori | 49/380 |
| 5,722,203 | A | * | 3/1998 | Staples et al. | 49/380 |
| 5,787,639 | A | * | 8/1998 | Lamore, Jr. | 49/380 |
| 6,170,198 | B1 | * | 1/2001 | Staples et al. | 49/380 |
| 6,231,034 | B1 | | 5/2001 | Walker et al. | |
| 6,357,181 | B1 | * | 3/2002 | Triemstra | 49/380 |
| 6,615,500 | B2 | | 9/2003 | Hale et al. | |
| 7,118,143 | B2 | * | 10/2006 | L'Heureux et al. | 292/175 |
| 7,213,371 | B1 | * | 5/2007 | Vanderpan | 49/380 |
| 7,580,389 | B2 | | 8/2009 | Kirk et al. | |
| 7,716,886 | B2 | * | 5/2010 | Gordon | 52/213 |
| 7,882,662 | B2 | * | 2/2011 | Root et al. | 52/126.5 |
| 8,245,448 | B2 | * | 8/2012 | Crane et al. | 49/380 |
| 8,418,375 | B2 | | 4/2013 | Zadnik | |
| 8,517,342 | B2 | | 8/2013 | Dunca | |
| 8,677,636 | B2 | * | 3/2014 | Kelley | 33/194 |
| 9,033,378 | B2 | * | 5/2015 | Jenkins | 292/288 |
| 2003/0005641 | A1 | * | 1/2003 | Eakes et al. | 49/380 |
| 2003/0204961 | A1 | | 11/2003 | Sumner | |
| 2004/0060241 | A1 | * | 4/2004 | Staples et al. | 49/380 |
| 2004/0141829 | A1 | * | 7/2004 | Maruyama et al. | 411/437 |
| 2005/0102906 | A1 | * | 5/2005 | Massey et al. | 49/380 |
| 2006/0236611 | A1 | * | 10/2006 | Klingbyle | 49/380 |
| 2012/0017452 | A1 | | 1/2012 | Lam et al. | |
| 2012/0204434 | A1 | | 8/2012 | Kelley | |
| 2012/0255186 | A1 | | 10/2012 | Allen et al. | |

OTHER PUBLICATIONS

"EZ-Hang," http://www.ezhangdoor.com/home, Innovative Construction Enterprises, LLC, at least as early as Jul. 1, 2007.

File History for U.S. Appl. No. 13/371,004 downloaded Apr. 8, 2016 (88 pages).

Ideal Door Components Inc., "Lift Handle (LH) Information Sheet," Ideal Door Components webpage, retrieved Oct. 8, 2015, www.chicksdoorplugs.com/ (1 page).

Ideal Door Components, Inc., "Bolt Head Bit (BHB) Installation Instructions," Ideal Door Components webpage, retrieved Oct. 8, 2015, www.chicksdoorplugs.com/ (1 page).

Ideal Door Components, Inc., "Economy Door Plug Installation Instructions," Ideal Door Components webpage, retrieved Oct. 8, 2015, www.chicksdoorplugs.com/ (1 page).

Ideal Door Components, Inc., "Standard Door Plug Installation Instructions," Ideal Door Components webpage, retrieved Oct. 8, 2015, www.chicksdoorplugs.com/ (1 page).

Ideal Door Components, Inc., "Standard SideLite Plug Installation Instructions," Ideal Door Components webpage, retrieved Oct. 8, 2015, www.chicksdoorplugs.com/ (1 page).

Ideal Door Components, Inc., "Strap Door Plug Installation Instructions," Ideal Door Components webpage, retrieved Oct. 8, 2015, www.chicksdoorplugs.com/ (1 page).

Ideal Door Components, Inc., "Strike Plate SideLite Plug Installation Instructions," Ideal Door Components webpage, retrieved Oct. 8, 2015, www.chicksdoorplugs.com/ (1 page).

Ideal Door Components, Inc., "Universal Bushing (UVB) Installation Instructions," Ideal Door Components webpage, retrieved Oct. 8, 2015, www.chicksdoorplugs.com/ (1 page).

"Reveal Spacer," http://www.doorframer.com/index.php/spacing-products, Doorframer, Inc., at least as early as Nov. 16, 2007.

"The Quick Door Hanger," http://www.thequickdoorhanger.com/, Express Products, as least as early as Dec. 21, 2008.

Triad Merrick Machine Co., "Lock Straps & Hinge Protectors & Door Clips," Triad Ruvo webpage, retrieved Feb. 24, 2016, www.triadruvo.com.com, 2005 (2 pages).

* cited by examiner

SHIPMENT AND INSTALLATION OF PRE-HUNG DOORS DEVICE AND METHOD

CLAIM OF PRIORITY

This application claims the benefit of U.S. Provisional Application No. 62/082,953, filed Nov. 21, 2014, the content of which is herein incorporated by reference in its entirety.

FIELD OF THE TECHNOLOGY

The present application relates to a shipment device for pre-hung doors. More specifically, the present application relates to a stabilization and installation device for pre-hung doors.

BACKGROUND

Installing a door correctly can be difficult, including installing a pre-hung door. It requires that the door be level and properly spaced within the opening. Correct installation also requires that the reveals of the jamb be parallel with the door on all sides, and that the proper different spacing is present between the door perimeter and the door jamb. But holding the level, shimming and trying to maintain that required spacing is hard and the install usually ends up less than accurate.

Pre-hung doors have additional problems associated with the preparation for shipping and the shipping process itself. Improvements in installation and shipping tools could simplify the door shipping process, the installation process and improve the finished product.

SUMMARY

An embodiment described herein includes a door stabilization device. The door stabilization device comprises a clip component, a first fastener, and a second fastener portion. The clip component can include a first side portion, a second side portion, and a back portion. The first side portion and second side portions can extend in a similar direction from a surface of the back portion. The back portion defines a clip aperture. The clip component is configured to fit onto an edge of a door using a compression fit between the first side portion and the second side portion. The first fastener portion comprises a shaft portion and a head portion. The first fastener portion is configured to extend through the clip aperture and at least partially into a latchbolt aperture defined by the door. The second fastener portion is configured to mate with the first fastener portion. The second fastener portion is configured to fit at least partially within the latchbolt aperture and a door knob bore defined by the door. When the first fastener portion extends through the clip aperture and is mated with the second fastener portion, the back portion of the clip component is positioned in between the head portion of the first fastener portion and at least a portion of the second fastener portion.

In an embodiment, the first fastener portion mates with the second fastener portion through one or more of the following couplings: a threaded coupling, a magnetic coupling, an adhesive coupling, a snap fit coupling, and a friction fit coupling.

In an embodiment, the first side portion comprises a first side compressible portion extending towards the second side portion. The first side compressible portion engages a face of the door and applies a pressure to the face of the door when the clip component is installed on the edge of a door.

In an embodiment, the second side portion comprises a second side compressible portion extending towards the first projection.

In an embodiment, the second fastener portion comprises a substantially cylindrical body portion and an end portion.

In an embodiment, the end portion has a dimension in a direction perpendicular to a longitudinal axis of the body portion that is greater than a diameter of the body portion.

An embodiment described herein includes a door shipping and installation system. The door shipping and installation system includes a top part, a hinge side part, and a stabilization device. The top part is configured to fit onto a top edge of a door using a compression fit. The hinge side part is configured to fit onto an edge of the door using a compression fit. The stabilization device comprises a clip component and a fastener component. The clip component comprises a first side portion, a second side portion, and a back portion. The first side portion and the second side portions extend in a similar direction from a surface of the back portion. The back portion defines a clip aperture. The clip component is configured to fit onto an edge of a door using a compression fit between first side portion and the second side portion. The fastener component comprising a shaft portion configured to extend through the clip aperture, a portion of a door and a portion of a door jamb. The fastener component configured to couple the strike side portion of a door to a door jamb.

In an embodiment, the system further includes a strike side part configured to fit onto an edge of the door using a compression fit.

In an embodiment, the system further includes a level device attached to at least one of the top part, the hinge side part or the strike side part.

In an embodiment, the fastener component comprises a first fastener portion and a second fastener portion, wherein the first fastener portion is configured to mate with the second fastener portion.

In an embodiment, the stabilization device comprises a spacing portion.

In an embodiment, the spacing portion is at least 0.05 inches thick and not more than 0.25 inches thick.

In an embodiment, the hinge side part or a strike side part comprises an extension extending from a shim portion in a direction along the longest axis of the door.

An embodiment described herein includes an uninstalled pre-hung door system. The uninstalled pre-hung door system includes a door, a door frame, a hinge, and a tool system. The door includes a top door surface, a bottom door surface, a strike door surface and a hinge door surface. The door defines a door knob bore and a latchbolt aperture. The door frame comprises a top jamb surface, a strike jamb surface and a hinge jamb surface. The at least one hinge couples the hinge door surface to the door frame. The hinge is configured to allow the door to pivot relative to the door frame. The tool system, comprises a top part, a hinge side part and a stabilization device. The top part is configured to fit onto a top door surface of the door using a compression fit. The hinge side part is configured to fit onto the hinge door surface of the door using a compression fit. The stabilization device comprises a clip component and a fastener component. The clip component comprises a first side portion, a second side portion, and a back portion. The first side portion and second side portions extend in a similar direction from a surface of the back portion. The back portion defines a clip aperture. The clip component is configured to fit onto the strike door surface of a door using a compression fit between first side portion and the second side portion. The fastener component comprises a shaft portion configured to extend through the clip aperture, a portion of the door and a portion of the door frame, the fastener component configured to couple the strike door surface to the strike jamb surface.

In an embodiment, the tool further comprises a strike side part configured to fit onto the strike door surface of the door using a compression fit.

In an embodiment, the door and the door frame are wrapped by a covering material.

In an embodiment, the covering material is a polymer.

In an embodiment, the latchbolt aperture extends inward from the strike door surface.

In an embodiment, the door knob bore extends from a first face of the door to a second face of the door.

In an embodiment, the latchbolt aperture connects to the door knob bore, and the latchbolt aperture is perpendicular to the door knob bore.

An embodiment described herein includes a method for shipping a pre-hung door. The method includes placing a top part on a top edge of a door; placing a hinge part on a hinge edge of the door; and placing a door stabilization device on a strike edge of a door, through a door frame, and through a latchbolt aperture defined by the door. The door stabilization device prevents the door from pivoting relative to the door frame. The door stabilization device comprises a clip component and a fastener component. The clip component comprises a first side portion, a second side portion, and a back portion, the first side portion and second side portions extending in a similar direction from a surface of the back portion, the back portion defining a clip aperture, the clip component configured to fit onto the strike edge using a compression fit between first side portion and the second side portion. The fastener component comprises a shaft portion configured to extend through the clip aperture, a portion of the door and a portion of the door frame.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

Figure 1:
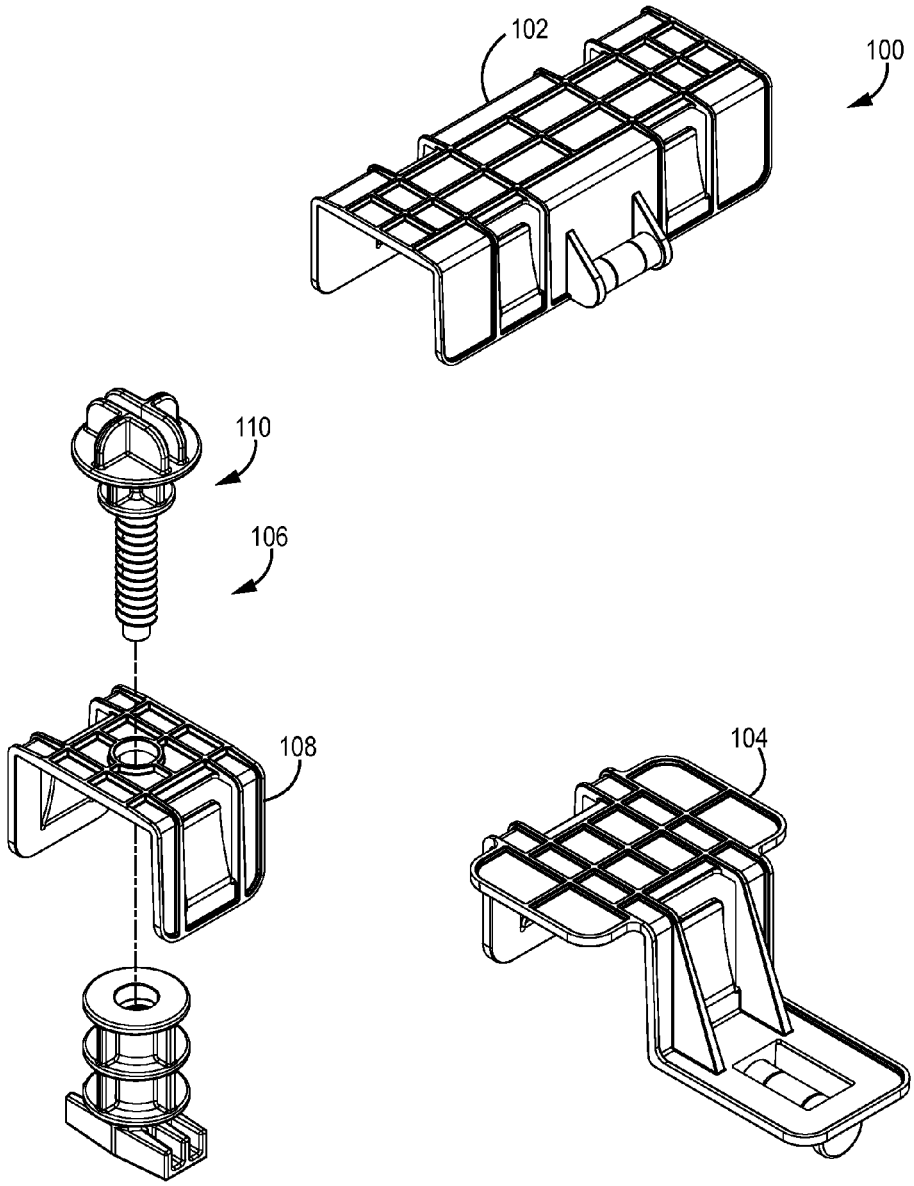
FIG. 1 is a perspective view of components in a door shipping and installation system, according to an embodiment.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

In one embodiment, a shipping and installation tool system includes parts that attach to three edges of a door to provide spacing and stability to assist with shipping and installation. The door includes two major sides: the hinge-pin side and the opposite or strike side. The door also includes perimeter sides defined by a hinge side, a top side, a strike side opposite the hinge side and a bottom side. Doors are often sold as a pre-hung door system where the door or door slab is hung within an assembled unit that includes at least three sides of a door frame and hinges attach the door slab to the door frame. The door frame includes at least two vertical elements which are the hinge jamb and the strike jamb. The door frame also includes a top rail connecting the hinge jamb and the strike jamb at the top of the frame.

To install a pre-hung door system, the door frame is attached to a wall within an opening in the wall. The opening in the wall is defined by the framework of the wall. For proper door operation, specific spacing is recommended between the door slab and the door frame. For example, many manufacturers recommend strike-side spacing of about ⅛ inch (3 mm), hinge-side spacing of about 3/64 inch (1.2 mm) and top spacing of about ⅛ inch (3 mm). The tool described herein can help the installer to establish the correct spacing and maintain the spacing from assembly through shipping and installation.

In one embodiment, the parts that make up the tool include the top part, hinge side part and the stabilization device. In some embodiments, the tool can further comprise a strike side part. Each part can attach to the door slab sides with a compression fit or friction fit, so that they can be easily attached and detached without the use of any tools or any damage to the door slab. The top part, hinge side part and stabilization device can all include a shim portion which is constructed to provide the correct spacing between the door frame and the door slab. The tool can also include at least one level device in order to indicate to the installer when the door slab is level. In one embodiment, both the hinge side part and the top part include a level device.

In one embodiment, the stabilization device can include a fastener component and a clip component. The clip component can attached to the door slab with a compression fit or friction fit and be sized to maintain a desired spacing between the door slab and the strike side jamb. The fastener component can extend through the door jamb, the clip component and into the door slab. The fastener component can couple the strike side of the door to the strike side portion of the jamb. The fastener component can prevent the door from swinging or pivoting relative to the door jamb.

Most commercially-available door slabs have a thickness of either about 1¾ inches (4.4 cm) or about 1⅜ inches (3.5 cm). In one embodiment, the three parts of the door installation tool are each provided with at least one fold-down tab so that the part can be configured to fit either of these two typical door thicknesses, such as described in U.S. Pat. No. 8,677,636, issued on Mar. 25, 2014. The contents of U.S. Pat. No. 8,677,636 are herein incorporated by reference in their entirety.

In one embodiment, an installation tool system includes one top part, one hinge side part and one stabilization device. In another embodiment, an installation tool system includes one top part, one hinge side part, one stabilization device and one strike side part. In yet another embodiment, an installation tool system includes one top part, two hinge side parts, one stabilization device and two strike side parts. In yet another embodiment, an installation tool system includes one top part, three hinge side parts, one stabilization device and two strike side parts. In one embodiment, each of the strike side parts are identical to each other and each of the hinge side parts are identical to each other.

Figure 3:
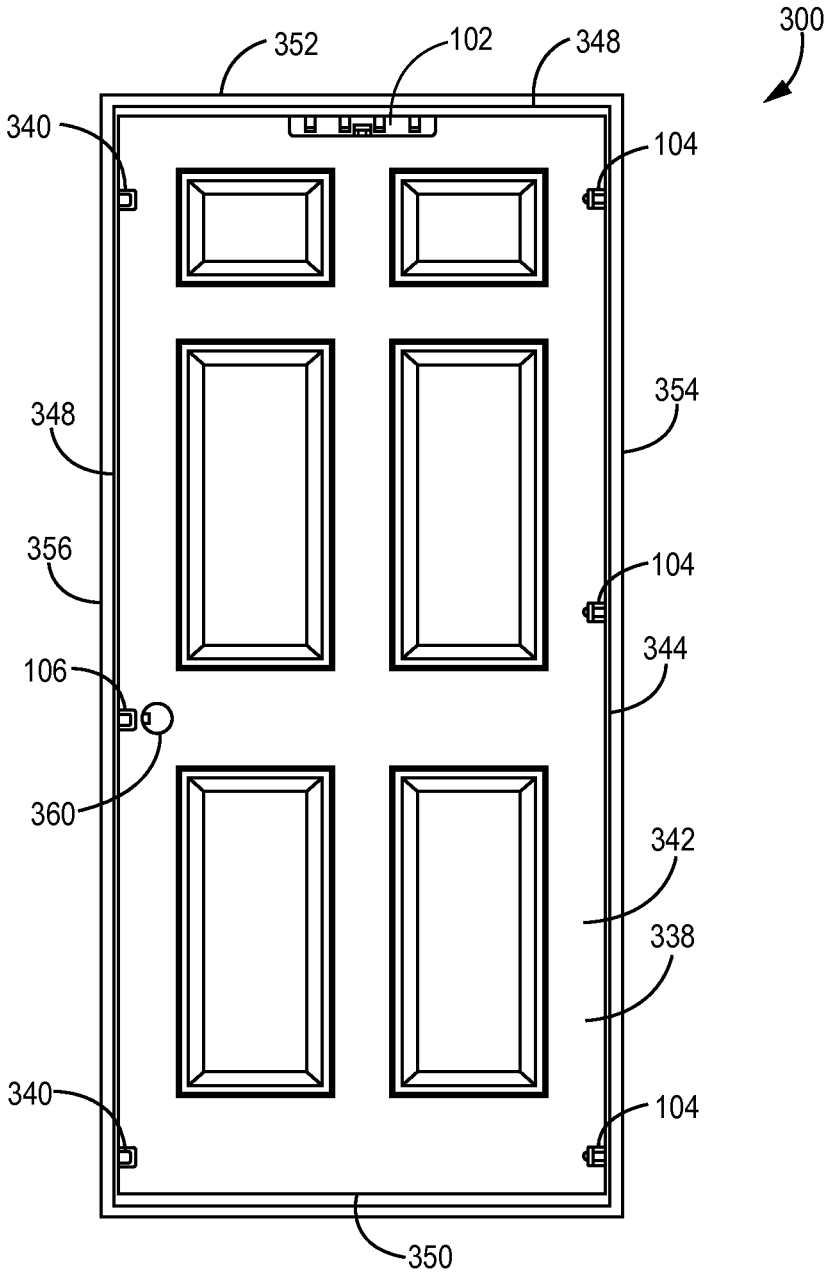
FIG. 3 is a front view of a pre-hung door, according to an embodiment.

FIG. 1 shows a perspective view of a door shipping and installation system 100, according to an embodiment. The installation system 100 includes a top part 102, a hinge side part 104 and a door stabilization device 106. In various embodiments, the installation system 100 can include a strike side part, such as shown in FIG. 3.

The top part 102 can be configured to fit onto the top edge or surface of a door using a compression fit. The top part 102 can provide and maintain proper spacing between a top surface of a door and a top jamb of a door frame. In some embodiments, the top part 102 can include a level, such as to ensure the door is properly aligned during installation.

The hinge side part 104 can be configured to fit onto an edge or surface of a door, such as the hinge edge, using a compression fit. The hinge side part 104 can provide and maintain proper spacing between the hinge surface of a door and the hinge jamb of a door frame. In some embodiments, the hinge side part 104 can include a level, such as to ensure the door is properly aligned during installation.

The stabilization device 106 can be configured to couple the strike side of a door to the strike jamb of a door frame, such as to stabilize the door during shipment or installation. The stabilization device 106 includes a clip component 108 and a fastener component 110. The clip component 108 can provide and maintain proper spacing between the strike surface of a door and the strike jamb of a door frame.

The fastener component 110 can extend through strike jamb, through the clip component 108 and into a portion of the door. The fastener component 110 can extend through a latchbolt aperture defined by the door and into a doorknob bore defined by the door. In various embodiments, the latchbolt aperture can be perpendicular to the doorknob bore. The latchbolt aperture can intersect with the doorknob bore. The latchbolt aperture can extend inward from the strike surface of the door.

The fastener component 110 can couple the strike side of a door to the strike jamb of a door frame, such as to prevent the door from pivoting relative to the door frame during shipping or installation. The door can pivot relative to the door frame along a hinge that couples the hinge side of the door to the hinge jamb of the door frame. The hinge can include a pivot axis that extends longitudinally, such as parallel to the longest edges of a door. In ordinary use of the door, the door can pivot from an open position to a closed position.

Figure 2:
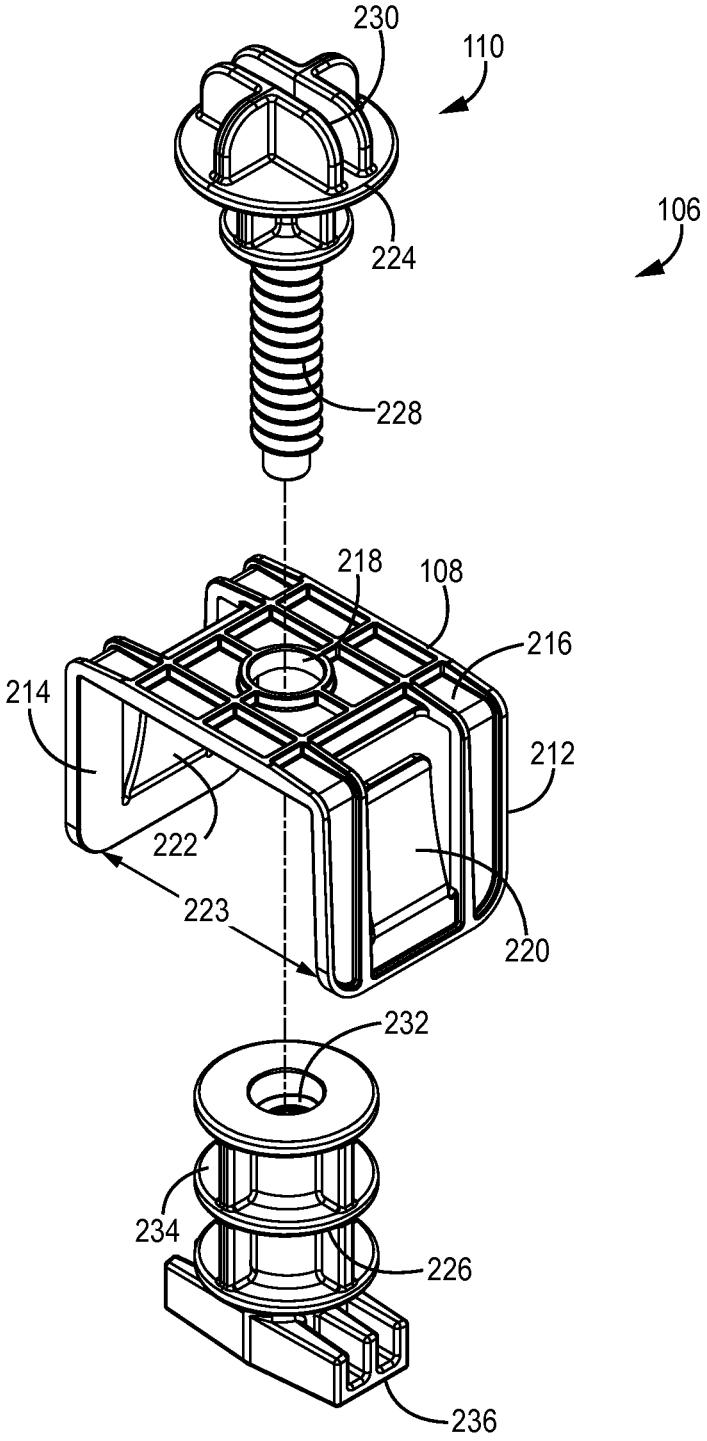
FIG. 2 is an exploded view of a door stabilization device, according to an embodiment.

FIG. 2 is an exploded view of a door stabilization device 106, according to an embodiment. The stabilization device 106 can include a clip component 108 and a fastener component 110.

The clip component 108 can comprise a first side portion 212 and a second side portion 214 extending from a back portion 216. The back portion 216 can be a spacing portion or shim portion, such that the back portion can be sized to provide and maintain the desired spacing between the strike side of the door and the strike jamb of the door frame. In an embodiment, the back portion 216 is at least 0.09375 inches (2.38125 mm) thick and not more than 0.1875 inches (4.7625 mm) thick. In an embodiment, the back portion 216 is at least 0.05 inches (1.27 mm) thick and not more than 0.25 inches (6.35 mm) thick. It will be understood by those of ordinary skill in the art that the thickness of the back portion can be sized differently from these examples based on the type of door system.

The first side portion 212 and the second side portion 214 can extend from a surface of the back portion 216 in the same direction. In some embodiments, the first side portion 212 and the second side portion 214 can be parallel, such as when both side portions 212, 214 extend from the back portion 216 at a ninety degree angle. In some embodiments, one of the side portion 214, 216 can extend from the back portion at an angle of less than ninety degrees, such as eighty five degrees, and the other side portion 214, 216 can extend from the back portion at a ninety degree angle.

The first side portion 212, the second side portion 214 and the back portion 216 can define a channel 223. The channel 223 can be sized such that the clip component 218 can fit over the strike edge of a door with a portion of the door disposed within the channel 223. The clip component can be configured to fit onto an edge of a door using a compression fit between the first side portion 214 and the second side portion 216.

The back portion 216 can define a clip aperture 218. In an installed state, the fastener component 110 can extend through the clip aperture 218. The clip aperture 218 can be configured and sized to allow the fastener component 110 to extend through the clip aperture 218. In some embodiments, the clip aperture can be "U" shaped and extend to from one perimeter edge of the back portion to another perimeter edge of the back portion, such as to define a slot.

In various embodiments, the first side portion 212 can include a first compression portion 220. The second side portion 214 can include a second compression portion 222. The first compression portion 220 can extend from the first side portion 212 towards the second side portion 214, such as into the channel. The second compression portion 222 can extend from the second side portion 214 towards the first side portion 212, such as into the channel.

In some embodiments, such as shown in FIG. 2, the compression portions 220, 222 can include a tab that extends into the channel. The tab can be compressed when the clip component 108 is fit onto a door, such as to provide a tighter compression fit. The tab can extend into the channel when the clip component 108 is not placed on the edge of a door. When the clip component 108 is placed on the edge of a door the tabs can be compressed towards the first side portion 212 of the second side portion 214, depending on which side portion the tab extends from. In an embodiment, a tab can be attached to a side portion 212, 214 at one end, and the second end of the tab can extend into the channel. In other embodiments, the compression portion can include a compressible material, such as foam or rubber, which can compress when the clip component 108 is fit onto a door. The compressible material can be attached to an inside surface of one or both of the side portions 212, 214. A compressible portion can engage a face of the door and apply a pressure to the face of the door when the clip component is installed on the edge of a door. The compressible portions can engage opposite faces of the door, such as one engaging the front face of the door and one engaging the back face.

The fastener component can comprise a first fastener portion 224 and a second fastener portion 226. In an embodiment, the first fastener portion 224 can be configured to extend through the clip aperture and at least partially into the latchbolt aperture. The second fastener portion 226 can be configured to fit at least partially within the latchbolt aperture and the doorknob bore.

The first fastener portion 224 and the second fastener portion 226 can be configured to mate together or couple together. In various embodiments, the first fastener portion 224 can mate with the second fastener portion 226 through a threaded coupling, such as when one of the two fastener portions 224, 226 defines a threaded shaft and the other portion 224, 226 defines a threaded cavity, such as shown in FIG. 2.

Alternative for coupling the first fastener portion 224 with the second fastener portion 226 are also possible. In various embodiments, the first fastener portion 224 can mate with the second fastener portion 226 through a magnetic coupling, an adhesive coupling, a snap fit coupling, or a friction fit coupling.

In an embodiment, the fastener component 110 can include a shaft portion that is configured to extend through the clip aperture 218. The shaft portion can further extend through a portion of a door, such as the latchbolt aperture, and through a portion of a door jamb.

In an embodiment, the first fastener portion 224 can include a shaft portion 228 and a head portion 230. In various embodiments, the shaft portion 228 can be threaded. The head portion 230 can have a larger width or diameter than the shaft portion 228, such as to allow the shaft portion 228 to extend through the clip aperture 218 and prevent the head portion 228 from being pulled through the clip aperture or a hole in the door frame which the shaft 228 extends through. In an embodiment, the head portion 230 can define a slot, such as a slot configured to accept the end of a screwdriver when coupling the first fastener portion 224 to the second fastener portion 226.

The shaft portion 228 can be substantially cylindrical, such that the shaft portion 228 generally defines a cylinder. The shaft portion can include threads or other inconsistencies and still be considered cylindrical. The outer most edge of the shaft portion can define a diameter of the substantially cylindrical shape and the length of the shaft portion can define the height or length of the substantially cylindrical shape. Similarly, the head portion 230 can be substantially cylindrical.

The second fastener portion 226 can define a receiving cavity 232 to receive a portion of the first fastener portion 224, such as the shaft 228. In an embodiment, the cavity 232 can be threaded, such as to mate with a threaded shaft 228.

The second fastener portion 226 can include a body portion 234 and an end portion 236. The body portion 234 can be generally cylindrical. The end portion 236 can be wider than the body portion 234, such as having a dimension in a direction perpendicular to a longitudinal axis of the body portion 234 that is greater than a diameter of the body portion 234, in order to prevent the end portion 236 from being pulled into the latchbolt aperture. In various embodiments, the end portion 236 can include a finger-turn structure, which is a structure that is configured to be engaged by human fingers and turned to tighten the coupling between the first fastener portion 224 and the second fastener portion 226. In the example of FIG. 2, planar ridges intersect at a right angle to form a finger-turn structure.

FIG. 3 is a front view of a pre-hung door 300 with the shipping and installation system 100 with one embodiment of a door shipping and installation tool or system 100 attached to the door slab 338. The door 338 is generally a rectangular prism. In this embodiment, the tool 100 includes three hinge side parts 104, one top part 102, one door stabilization device 106 and two strike side parts 340. In various embodiments, the strike side parts 340 can be identical to the clip component 108 included in the stabilization device. In other embodiments, the strike side parts 340 can be identical to the clip component 108, except that the strike side parts might not define a clip aperture.

The door slab 338 includes a hinge-pin side and an opposite side. The door slab 338 include a front surface 342 and an opposite back surface, where the front surface 342 is facing the viewer in FIG. 3. Around its perimeter, the door slab 338 also includes a hinge side 344, a top side 346, a strike side 348 opposite the hinge side 344 and a bottom side 350.

The door frame 352 includes at least two vertical elements which are the hinge jamb 354 and the strike jamb 356. The door frame 352 also includes a top rail 358 connecting the hinge jamb 354 and the strike jamb 356 at the top of the frame. The door slab 338 is attached to the door frame by one or more hinges (not shown). The pre-hung door 300 is positioned within an opening in a wall, where a framework is positioned in the opening. In some embodiments, the hinge side part and top side part can both include a level device, which can be used by the installer to position the door properly within the framework and opening. It is also possible for the tool to include only a single level. It is also possible for the tool to include one or more levels positioned elsewhere on the tool.

The door 338 can define a doorknob bore 360. The doorknob bore 360 can be substantially cylindrical and extend from the front face 342 of the door to the back face of the door. The door knob bore 360 can be configured to house a portion of the doorknob when the doorknob is installed in the door 338.

In various embodiments, prior to shipping the pre-hung door 300, the door 338 and the frame 352 are wrapped in a covering material. In an embodiment, the covering material is a polymer, such as a translucent polymer. In some scenarios, the covering material can be wrapped too tightly, such that the frame can bend towards the door. The tool parts described herein can maintain the spacing between the door and the door frame during shipping and installation.

Figure 4:
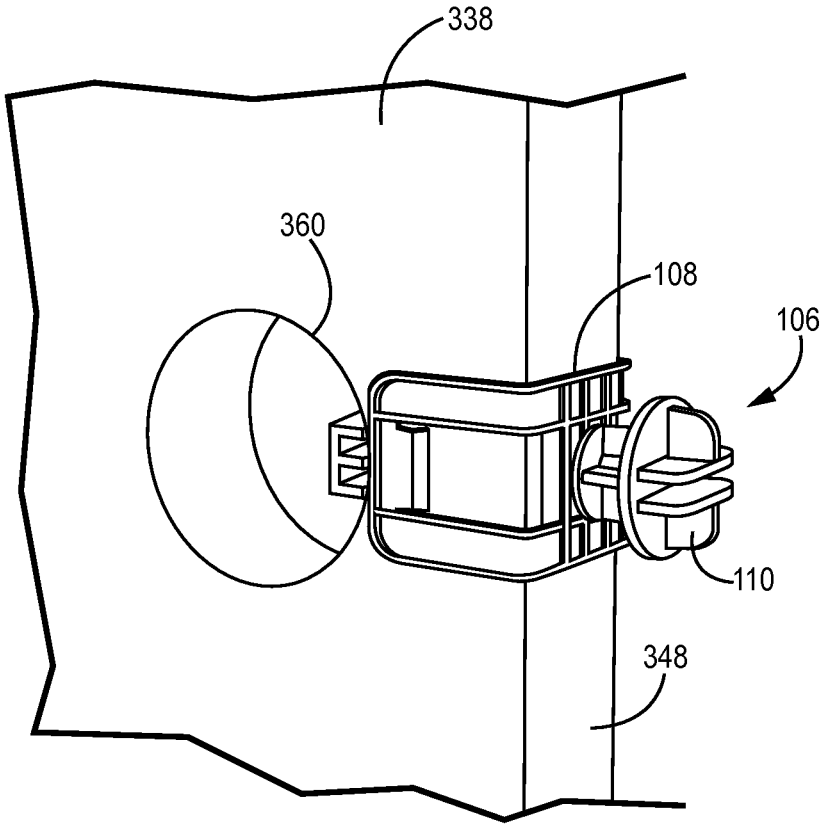
FIG. 4 is a perspective view of a portion of a pre-hung door, according to an embodiment.

FIG. 4 is a perspective view of a portion of a pre-hung door with a door stabilization device installed, according to an embodiment. For clarity, the door frame is not shown in FIG. 4. FIG. 4 shows the clip component 108 on the edge of a door, specifically on the strike edge of the door. The fastener component 110 extends through the latchbolt aperture in the door, through the clip component and through the door frame. In such an arrangement, the back portion clip component is posited in between the door frame and the door. Further, the back portion of the clip component is positioned between the head portion 230 of the first fastener component and the end portion 236 of the second fastener portion 226.

Figure 5:
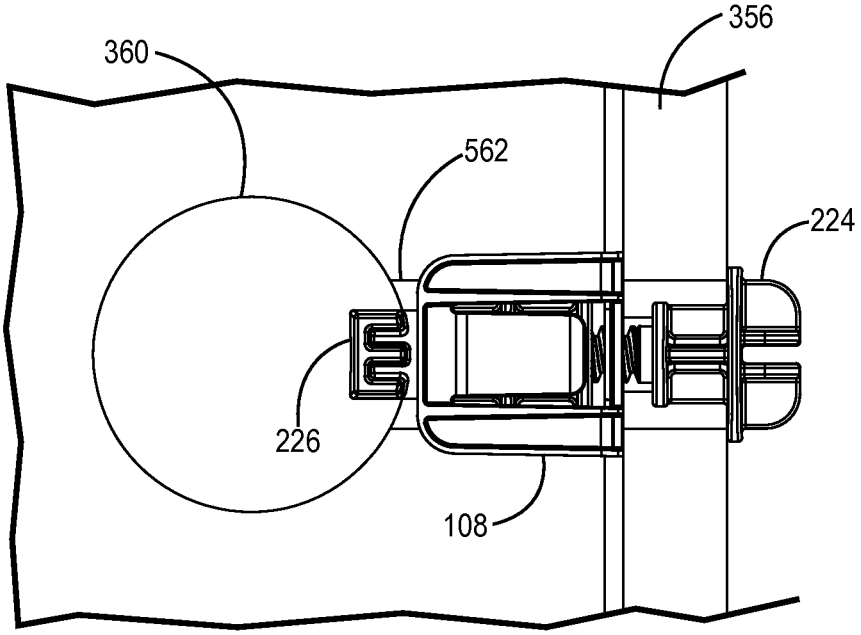
FIG. 5 is a cross-sectional view of a portion of a pre-hung door, according to an embodiment.
Figure 6:
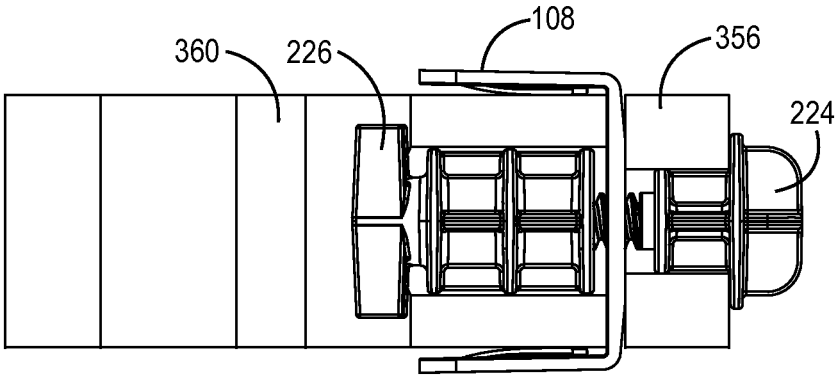
FIG. 6 is a cross-sectional view of a portion of a pre-hung door, according to an embodiment.

FIG. 5 is a cross-sectional front view of a portion of a pre-hung door, according to an embodiment. FIG. 6 is a cross-sectional top view of a portion of a pre-hung door, according to an embodiment. FIGS. 5-6 show the doorknob bore 360 intersecting with the latchbolt aperture 562.

As shown in FIGS. 5-6, the fastener component 110 can extend through the strike jamb 356, through the clip component 108, through the latchbolt aperture 562 and into the doorknob bore 360. In various embodiments, the first fastener portion 224 can mate with the second fastener portion 226 within the latchbolt aperture. FIGS. 5-6 further show the space between the strike edge of the door and the strike jamb 356 being maintained by the back portion 216 of the clip component 108. The clip component 108, the strike jamb 356, and a portion of the door can be sandwiched between the end portion 236 and the head portion 230, such as to secure the strike edge of the door 338 to the door frame 352 during shipping.

Figure 7:
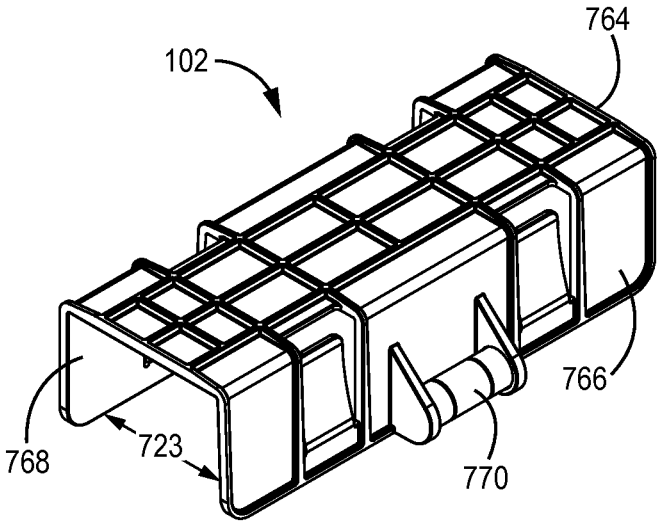
FIG. 7 is a perspective view of a top part, according to an embodiment.
Figure 8:
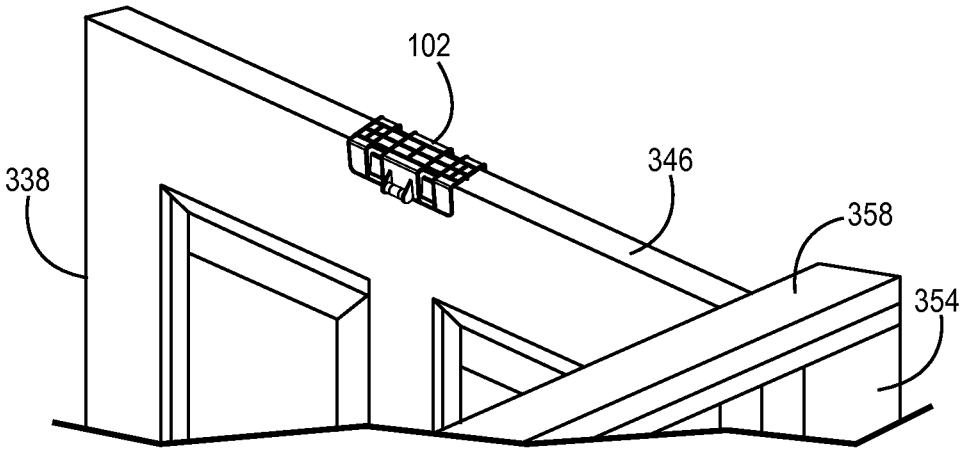
FIG. 8 is a perspective view of a top part on a door, according to an embodiment.

One embodiment of a top side part 102 is shown in a perspective view in FIG. 7 and a perspective view of the top part 102 attached to a door slab 338 is shown in FIG. 8. The top part 102 can include a shim portion 764 which will preserve the proper space between the top side of the door slab and the top jamb of the door frame. In some embodiments, the shim portion 764 is at least 0.09375 inches (2.38125 mm) thick and not more than 0.1875 inches (4.7625 mm) thick. In some embodiments, the shim portion 764 is at least 0.05 inches (1.27 mm) thick and not more than 0.25 inches (6.35 mm) thick.

When the top part 102 is attached to the door slab 338, the shim portion 764 will be flush against the top side of the door slab 338. In one embodiment, the shim portion 120 has a ramped or sloped portion. After the top part 102 is installed on the top side of a door, the door slab is moved to a closed position within the door frame. The ramped portion can help to guide the door slab 338 into position within the door frame 352.

The top part 102 can define a channel 723 that receives the door slab 338 to secure the top part 102 to the door. The top part 102 includes a first side portion 766 attached to one side of the shim portion 764 and a second side portion 768 attached to the opposite side.

In one embodiment, the first side portion 766 and the second side portion are attached to the shim portion 764 at angles of about ninety degrees or slightly less than ninety degrees. If at least one of the angles is less than 90 degrees, the channel 723 has an over-bend configuration that allows the top part 102 to compression fit or friction fit around the door edge to secure the top part in place without damaging the door slab. In one embodiment of the top part 102, one of the side portion 766, 768 is attached to the shim portion 764 at an angle of about 88 degrees and the other side portion 766, 768 is attached to the shim portion 764 at an angle of about 90 degrees.

In an embodiment, the top part 102 is longer than either the hinge side part 104 or the strike side part 340. In one embodiment, the top part 102 has a length of about 10.5 inches (26.7 cm), while each of the hinge side part 104 and strike side part 340 has a length of about 1⅜ inch (3.5 cm).

In various embodiments, a level 770 is also included on the top part 102. In one embodiment, the level 770 is positioned on the first side portion 766. By watching to see if the bubble of the level is centered, the installer can determine if the door is level on the horizontal axis. In the embodiment of FIGS. 7-8, the level 770 is held to the top part 102 by two level brackets which are integral with the level portion of the top part 102. In another embodiment, the level is attached using adhesive. In another embodiment, the level portion includes a clip into which a level can snap.

Similar to the clip component 108, the top part 102 can include a compression portion on the first side portion 766 and/or a compression portion on the second side portion 768. The compression portion can project from the side portion into the channel 723 and towards the other side portion. The compression portion can be compressed when the part is placed on a door slab 338 to aid in the compression fit.

FIG. 8 is a perspective view of a top part 102 on a door 338 with the door in an open position, according to an embodiment. The shim portion 764 can be flush with a top surface 346 of the door 338. The shim portion 74 can be parallel with the top surface 346.

Figure 9:
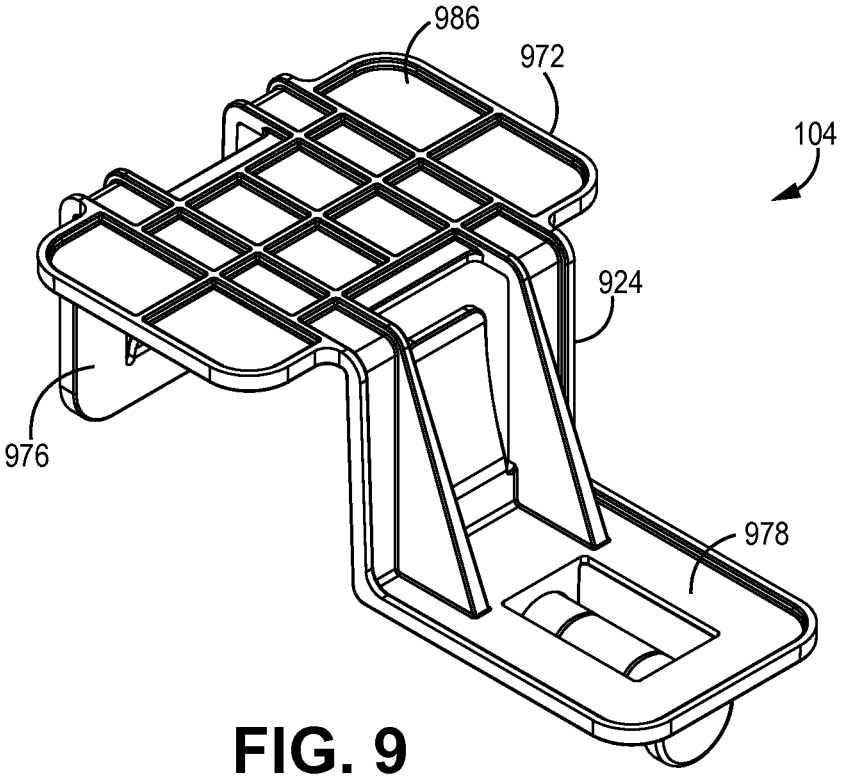
FIG. 9 is a perspective view of a strike side part, according to an embodiment.

FIG. 9 is a perspective view of a hinge side part 104, according to an embodiment. The hinge side part 104 can include a shim portion 972, a first side portion 974, a second side portion 976, and a level portion 978. In an embodiment, the hinge side part 104 can include an extension 986.

The extension 986 generally has the same thickness as the shim portion 972. The extension 986 extends from the shim portion 972. In an embodiment, the extension 986 is integral with the shim portion 972. The extension 986 can extend past the edge of the first side portion 974 and the second side portion 976 in one direction or in both directions (shown in FIG. 9). Also as shown in FIG. 9, the hinge side part 104 can include two extensions extending from the shim portion 972 in opposite directions. In an embodiment, the extension extends in a direction along the longest axis of the door.

The other components, the top part 102, the clip component 108 and the strike side part 340 can also include one or more extensions. It should be understood that a top part 102 including extensions will extend perpendicular to the longest axis of the door.

Figure 10:
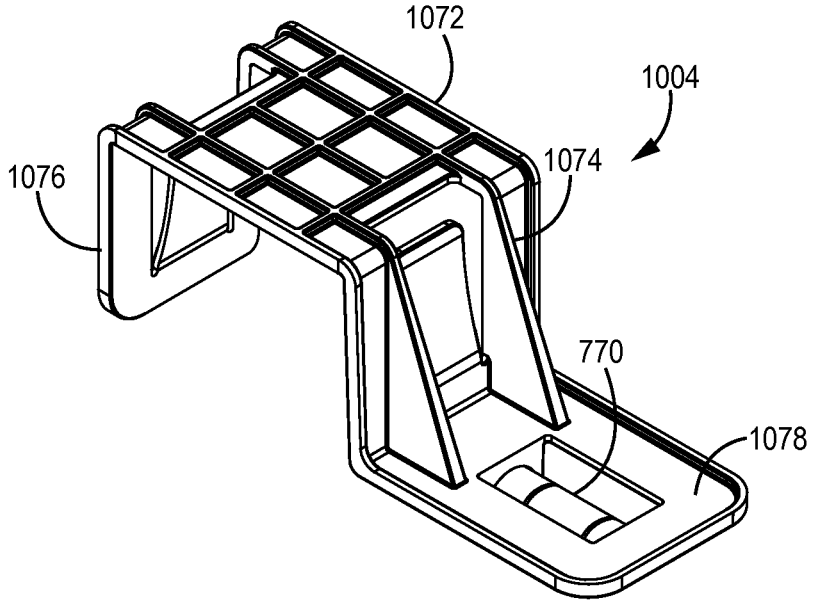
FIG. 10 is a perspective view of a hinge side part, according to an embodiment.
Figure 11:
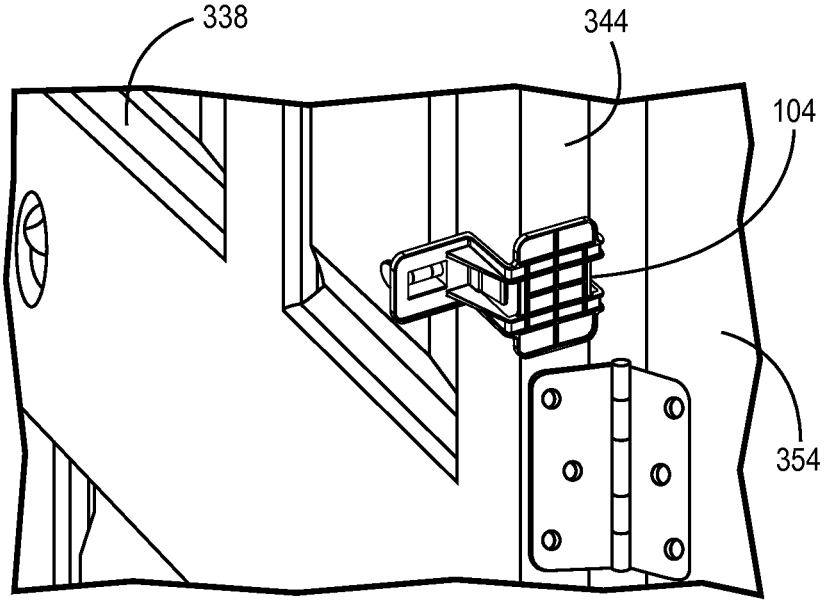
FIG. 11 is a perspective view of a hinge side part on a door, according to an embodiment.

One embodiment of a hinge side part 1004 is shown in a perspective view in FIG. 10 and a perspective view of the hinge side part on a door slab 338 is shown in FIG. 11. The hinge side part 1004 can include a shim portion 1072 which can preserve the proper space between the hinge side of the door slab and the hinge jamb of the door frame. In one embodiment, the shim portion 1072 has a uniform thickness as shown in FIG. 10. In an embodiment, the shim portion 1072 is at least 0.0625 inches (1.5875 mm) thick and not more than 0.125 (3.175 mm) inches thick. In an embodiment, the shim portion 1072 is at least 0.05 inches (1.27 mm) thick and not more than 0.25 inches (6.35 mm) thick.

When the hinge side part 104 is attached to the door slab 338, the shim portion 972 will be flush against the hinge side surface 344 of the door slab, as shown in FIG. 11. The thickness of the shim portion 972 of the hinge side part 104 will determine the spacing between the hinge side of the door slab and the hinge jamb of the door frame during the installation process. In one embodiment, the shim portion is rigid and not compressible.

The hinge side part 104 can define a channel that receives the door slab 338 to secure the hinge side part 104 to the door, similar to the channel 223 defined by the clip component 108 or the channel 723 defined by the top part. The channel is defined between a first side portion 1074 attached to one side of the shim portion 1072 and a second side portion 1076 attached to the opposite side. In one embodiment, the first side portion 1074 and the second side portion 1076 are attached to the shim portion 1072 at angles of about ninety degrees or slightly less than ninety degrees. In an embodiment, the first side portion 1074 is parallel to the second side portion 1076. If at least one of the attachment angles is less than 90 degrees, the channel has an over-bend configuration that allows the hinge side part 104 to compression fit around the door edge to secure the hinge side part 104 in place without damaging the door slab 338. In one embodiment of the hinge side part 104, one of the side portions 1074, 1076 is attached at an angle of about 85 degrees and the other side portion 1074, 1076 is attached at an angle of about 90 degrees.

In various embodiments, a level 770 is also included on the hinge side part 1004. In one embodiment, the level 770 is positioned on a level portion 1078 that projects away from the first side portion 1074, such as at about a ninety degree angle. By watching to see if the bubble of the level is centered, the installer can determine if the door is level on the vertical axis. In the embodiment of FIG. 10, the level is held by two level brackets which are integral with the level portion 1078 of the hinge side part 104. In another embodiment, the level 770 is attached using adhesive. In another embodiment, the level portion 1078 includes a clip into which a level can snap.

Figure 12:
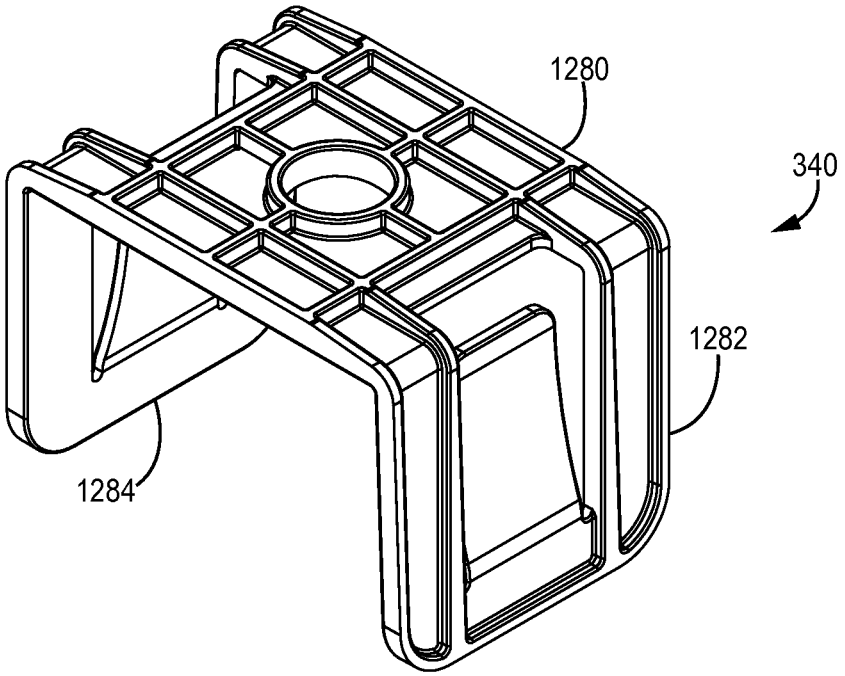
FIG. 12 is a perspective view of a strike side part, according to an embodiment.

FIG. 12 is a perspective view of a strike side part 340, according to an embodiment. In various embodiments, the strike side part 340 can be similar to the clip component 108. In some embodiments, the strike side part 340 is identical to the clip component 108. In some embodiments, the strike side part 340 does not define a clip aperture but is otherwise identical to the clip component 108.

The strike side part 340 can include a shim portion 1280 which can preserve the proper space between the strike side of the door slab and the strike jamb of the door frame. In one embodiment, the shim portion 1280 has a uniform thickness as shown in FIG. 12. In an embodiment, the shim portion 1280 is at least 0.09375 inches (2.38125 mm) thick and not more than 0.1875 (4.7625 mm) inches thick. In an embodiment, the shim portion 1280 is at least 0.05 inches (1.27 mm) thick and not more than 0.25 inches (6.35 mm) thick.

When the strike side part 340 is attached to the door slab 338, the shim portion 1280 will be flush against the strike side surface 348 of the door slab. The thickness of the shim portion 1280 of the strike side part 340 will determine the spacing between the strike side of the door slab and the strike jamb of the door frame during the installation process. In one embodiment, the shim portion 1280 is rigid and not compressible.

The strike side part 340 can define a channel that receives the door slab 338 to secure the strike side part 340 to the door. The channel is defined between a first side portion 1282 attached to one side of the shim portion 1280 and a second side portion 1284 attached to the opposite side. In one embodiment, the first side portion 1282 and the second side portion 1284 are attached to the shim portion 1280 at angles of about ninety degrees or slightly less than ninety degrees. In an embodiment, the first side portion 1282 is parallel to the second side portion 1284. If at least one of the attachment angles is less than 90 degrees, the channel has an over-bend configuration that allows the strike side part 340 to compression fit around the door edge to secure the strike side part 340 in place without damaging the door slab 338. In one embodiment of the strike side part 340, one of the side portions 1282, 1284 is attached at an angle of about 85 degrees and the other side portion 1282, 1284 is attached at an angle of about 90 degrees.

In one embodiment, each of the parts of the tool defines a channel bordered by the shim portion, first side portion and second side portion. As discussed herein, the angle formed between the first side portion and shim portion of each part and the angle formed between the shim portion and the second side portion can be about ninety degrees or slightly less than ninety degrees. In one embodiment, the angles are both less than ninety degrees. In one embodiment, one of the angles is less than ninety degrees and the other angle is about ninety degrees. In one embodiment, one of the angles is at least about eighty degrees. In one embodiment, one of the angles is at least about 84 degrees. In one embodiment, one of the angles is at least about 85 degrees. In one embodiment, one of the angles is about 85 degrees. In one embodiment, one of the angles is about 88 degrees.

Many different structures can be used to allow the parts to fit multiple door sizes. Some embodiments can include a compressible portion. Some embodiments can include fold-down tabs that can pivot between two positions corresponding to two different door thicknesses. In one embodiment, each part includes at least two tabs of two different sizes so that each part can be configured to fit three different door thicknesses. In one embodiment, each of the parts has two fold-down tabs of the same size. In one embodiment, spacing structures clip into or fit into the channel of each part to adjust the channel width.

In one embodiment, a level is present on at least one part of the tool. In one embodiment, a level device is present on the top part. In one embodiment, a level is present on at least one of the hinge side parts. In one embodiment, a level is present on all of the hinge side parts. In one embodiment, a level is present on all of the hinge side parts and the top part. In one embodiment, a level device is present on one or more of the strike side parts. In one embodiment the level has an open area underneath of it to allow the level to be read from all angles. In one embodiment, the level is held to the particular part between two brackets which are integral with the level portion of the hinge side part and the first side portion of the top part. In another embodiment, the level is attached using adhesive. In another embodiment, the level portion includes a clip into which a level can snap or be held.

In one embodiment, the parts of the tool are constructed of a hard material such as a plastic, a resin, a nylon resin or a thermoplastic material. The parts of the tool can be formed by injection molding, extrusion, metal bending or other methods. In one embodiment, the parts are formed by injection molding using a resin commercially available as ZYTEL® resin from DuPont. In one embodiment, an extrusion process is used to form at least one portion of each part. The FIGS. show ribs on some portions of the parts of the tool. In some embodiments, ribs are present in different locations or are not present.

In one embodiment, portions of the parts of the tool are formed using metal bending of a metal such a stainless steel. Edges of the tools are covered with soft rubber in one embodiment. In one embodiment, thermoforming techniques are used to form the parts of the tool.

Figure 13:
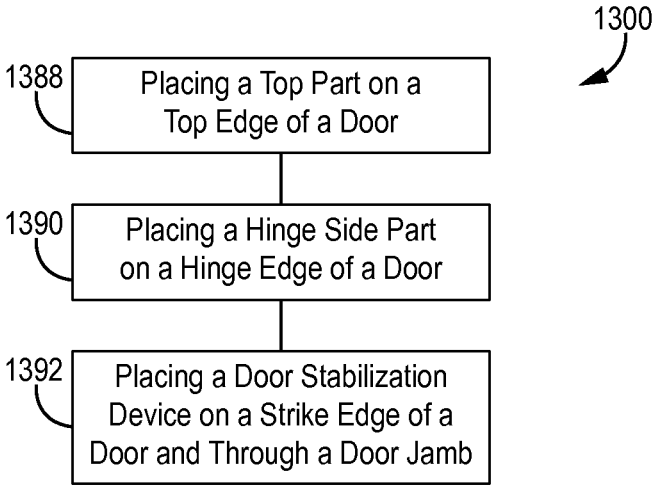
FIG. 13 is a flow chart depicting a method of shipping a pre-hung door, according to an embodiment.

FIG. 13 is a flow chart depicting a method of shipping a pre-hung door, according to an embodiment. The method 1300 includes placing the components of the stabilization and installation tool described herein on a door. The method 1300 includes placing a top part on the top edge of a door 1388. The method 1300 includes placing a hinge side part on the hinge edge of a door 1390. It should be understood that the parts can be placed on the door in any order. In various embodiments, the method 1300 further includes placing one or more strike side parts on the strike edge of the door.

The method can also include placing a door stabilization device on the strike edge of the door and through a portion of the door jamb 1392. The door stabilization device can also be placed such that it extends through the latchbolt aperture defined by the door. The door stabilization device prevents the door from pivoting relative to the door jamb during shipping and installation. In some embodiments, once the door slab is machined, it travels down a production line. A technician can place the top part, hinge side part and the clip component on the door slab. The technician can ensure that the clip aperture is aligned with the machined aperture in the door slab. The door slab with the parts attached to it can then be mated with a door frame. Once the door slab is mated or coupled to the door fame, the fastener component of the door stabilization device can be inserted through the door frame and through the clip component to secure the door slab to the frame during shipping. First, a first fastener portion is inserted through an opening in the door frame, through a clip aperture of the clip component, and at least partially into the latchbolt aperture. Then, a second fastener portion is attached to the end of the first fastener portion.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

The technology has been described with reference to various specific and preferred embodiments and techniques. However, it should be understood that many variations and modifications may be made while remaining within the spirit and scope of the technology.

The invention claimed is:

1. A door stabilization device, comprising:

a clip component comprising a first side portion, a second side portion, and a back portion, the first side portion and second side portions extending from a surface of the back portion, the back portion defining a clip aperture, the clip component configured to fit onto an edge of a door using a compression fit between the first side portion and the second side portion;

a first fastener portion comprising a shaft portion and a head portion, the first fastener portion configured to extend through the clip aperture and at least partially into a latchbolt aperture defined by the door; and a second fastener portion configured to mate with the first fastener portion, the second fastener portion configured to fit at least partially within the latchbolt aperture and a door knob bore defined by the door, wherein when the first fastener portion extends through the clip aperture and is mated with the second fastener portion, the back portion of the clip component is positioned in between the head portion of the first fastener portion and at least a portion of the second fastener portion.

2. The door stabilization device of claim 1, wherein the first fastener portion mates with the second fastener portion through one or more of the following couplings: a threaded coupling, a magnetic coupling, an adhesive coupling, a snap fit coupling, and a friction fit coupling.

3. The door stabilization device of claim 1, wherein the first side portion comprises a first side compressible portion extending towards the second side portion, wherein the first side compressible portion engages a face of the door and applies a pressure to the face of the door when the clip component is installed on the edge of a door.

4. The door stabilization device of claim 3, wherein the second side portion comprises a second side compressible portion extending towards the first projection.

5. The door stabilization device of claim 1, wherein the second fastener portion comprises a substantially cylindrical body portion and an end portion.

6. The door stabilization device of claim 5, wherein the end portion has a dimension in a direction perpendicular to a longitudinal axis of the body portion that is greater than a diameter of the body portion.

7. A door shipping and installation system, comprising:

a top part configured to fit onto a top edge of a door using a compression fit;

a hinge side part configured to fit onto an edge of the door using a compression fit;

and a stabilization device comprising:

a clip component comprising a first side portion, a second side portion, and a back portion, the first side portion and second side portions extending from a surface of the back portion, the back portion defining a clip aperture, the clip component configured to fit onto an edge of a door using a compression fit between first side portion and the second side portion; and a fastener component comprising a shaft portion configured to extend through the clip aperture, a portion of a door and a portion of a door jamb, the fastener component configured to couple the strike side portion of a door to a door jamb.

8. The door shipping and installation system of claim 7, further comprising a strike side part configured to fit onto an edge of the door using a compression fit.

9. The door shipping and installation system of claim 7, further comprising a level device attached to at least one of the top part, the hinge side part or the strike side part.

10. The door shipping and installation system of claim 7, wherein the fastener component comprises a first fastener portion and a second fastener portion, wherein the first fastener portion is configured to mate with the second fastener portion.

11. The door shipping and installation system of claim 7, wherein the stabilization device comprises a spacing portion.

12. The door shipping and installation system of claim 11, wherein the spacing portion is at least 0.05 inches thick and not more than 0.25 inches thick.

13. The door shipping and installation system of claim 7, wherein the hinge side part or a strike side part comprises an extension extending from a shim portion in a direction along the longest axis of the door.

14. An uninstalled pre-hung door system, comprising:

a door comprising a top door surface, a bottom door surface, a strike door surface and a hinge door surface, wherein the door defines a door knob bore and a latchbolt aperture;

a door frame comprising a top jamb surface, a strike jamb surface and a hinge jamb surface;

at least one hinge coupling the hinge door surface to the door frame; wherein the hinge is configured to allow the door to pivot relative to the door frame; and a tool system, comprising:

a top part configured to fit onto a top door surface of the door using a compression fit;

a hinge side part configured to fit onto the hinge door surface of the door using a compression fit; and a stabilization device comprising:

a clip component comprising a first side portion, a second side portion, and a back portion, the first side portion and second side portions extending from a surface of the back portion, the back portion defining a clip aperture, the clip component configured to fit onto the strike door surface of a door using a compression fit between first side portion and the second side portion; and a fastener component comprising a shaft portion configured to extend through the clip aperture, a portion of the door and a portion of the door frame, the fastener component configured to couple the strike door surface to the strike jamb surface.

15. The uninstalled pre-hung door system of claim 14, wherein the tool further comprises a strike side part configured to fit onto the strike door surface of the door using a compression fit.

16. The uninstalled pre-hung door system of claim 14, wherein the door and the door frame are wrapped by a covering material.

17. The uninstalled pre-hung door system of claim 16, wherein the covering material is a polymer.

18. The uninstalled pre-hung door system of claim 14, wherein the latchbolt aperture extends inward from the strike door surface.

19. The uninstalled pre-hung door system of claim 14, wherein the door knob bore extends from a first face of the door to a second face of the door.

20. A method for shipping a pre-hung door, comprising:

placing a top part on a top edge of a door;

placing a hinge part on a hinge edge of the door; and placing a door stabilization device on a strike edge of a door, through a door frame, and through a latchbolt aperture defined by the door;

wherein the door stabilization device prevents the door from pivoting relative to the door frame;

wherein the door stabilization device comprises:

a clip component comprising a first side portion, a second side portion, and a back portion, the first side portion and second side portions extending from a surface of the back portion, the back portion defining a clip aperture, the clip component configured to fit onto the strike edge using a compression fit between first side portion and the second side portion; and a fastener component comprising a shaft portion configured to extend through the clip aperture, a portion of the door and a portion of the door frame.

* * * * *